United States Patent [19]

Vignoli

[11] Patent Number: 4,895,531

[45] Date of Patent: Jan. 23, 1990

[54] ELECTRICAL CONTACT MEMBER

[75] Inventor: Guido Vignoli, Alta, Italy

[73] Assignee: AMP Incorporated, Harrisburg, Pa.

[21] Appl. No.: 223,837

[22] Filed: Jul. 25, 1988

[30] Foreign Application Priority Data

Nov. 16, 1987 [GB] United Kingdom ..... 8726806

[51] Int. Cl.[4] ..... H01R 4/24

[52] U.S. Cl. ..... 439/398; 439/404; 439/839

[58] Field of Search ..... 439/839, 844, 845, 827, 439/833, 842, 843, 856, 857, 389–407

[56] References Cited

U.S. PATENT DOCUMENTS

| | | | |
|---|---|---|---|
| 3,836,947 | 9/1974 | Yeager . | |
| 4,408,824 | 10/1983 | Weidler . | |
| 4,537,462 | 8/1985 | Manabe . | |
| 4,540,235 | 10/1985 | Lolic | 439/839 |
| 4,583,812 | 4/1986 | Gross, Jr. et al. . | |

FOREIGN PATENT DOCUMENTS

| | | | |
|---|---|---|---|
| 1028193 | 4/1958 | Fed. Rep. of Germany | 439/833 |
| 2105842 | 1/1973 | Fed. Rep. of Germany | 439/833 |
| 2455140 | 5/1976 | Fed. Rep. of Germany | 439/833 |
| 1304114 | 8/1961 | France . | |
| 2226093 | 11/1974 | France | 439/833 |

*Primary Examiner*—David Pirlot
*Attorney, Agent, or Firm*—William B. Noll

[57] ABSTRACT

An improved electrical contact member formed of an electrically conductive metal and adapted for mounting in a cavity in an insulated housing body, where said contact member is subjected to elevated temperatures sufficient to cause softening or relaxation of said metal. The improvement therein is achieved by the addition thereto of a U-shaped insert, fabricated from steel resistant to softening or relaxation at said elevated temperatures, at one end of said contact member.

3 Claims, 3 Drawing Sheets

ELECTRICAL CONTACT MEMBER

BACKGROUND OF THE INVENTION

This invention relates to an improved electrical contact member formed of an electrically conductive metal and adapted to be inserted into a cavity in an insulated housing body. The improvement thereto is the addition of a U-shaped insert fabricated from steel. Such improved contact, with insert, is particularly suitable for applications at elevated temperatures, where such temperatures can cause softening or relaxation of said electrically conductive metal.

An environment where such contact member can be effectively used is, for example, in the appliance field, such as electric dryers. As is well known, in such an appliance moderate heat must be generated to dry the clothes as they are tumbled within the dryer. By virtue of the compactness of the appliance, electrical contacts are subjected to the heat generated therein.

U.S. Pat. No. 4,540,234 represents a complex attempt at an electrical double flat spring contact in which there is employed an external over-spring fabricated from steel. However, the contact of the present invention is directed to a different type of contact, but nevertheless of a type where spring support is used.

SUMMARY OF THE INVENTION

An electrically conductive metal contact of the type used herein, is typically stamped and formed in one piece from a sheet metal strip, where the metal is plated or unplated copper, copper alloy, or bronze. Such metals or alloys, in addition to their known electrically conductive properties, are relatively soft making them ideal for stamping and forming. However, by virtue of this latter property, such metals and alloys, when subjected to elevated temperatures, can exhibit a significant relaxation, stress relief, or loss of flexibility. This can result in the breaking of the electrical circuit between the contact and the terminal, such as a tab, inserted therein.

The present invention overcomes the disadvantages associated with the type of metal contacts of the prior art by the inclusion of an insert fabricated from spring steel, which steel is resistant to the elevated temperatures to which the contact is subjected.

BRIEF DESCRIPTION OF THE DRAWINGS

A preferred embodiment of the improved metal contact of this invention will now be described, with particular reference to the accompanying drawings in which.

DETAILED DESCRIPTION OF PREFERRED EMBODIMENT

Figure 1:
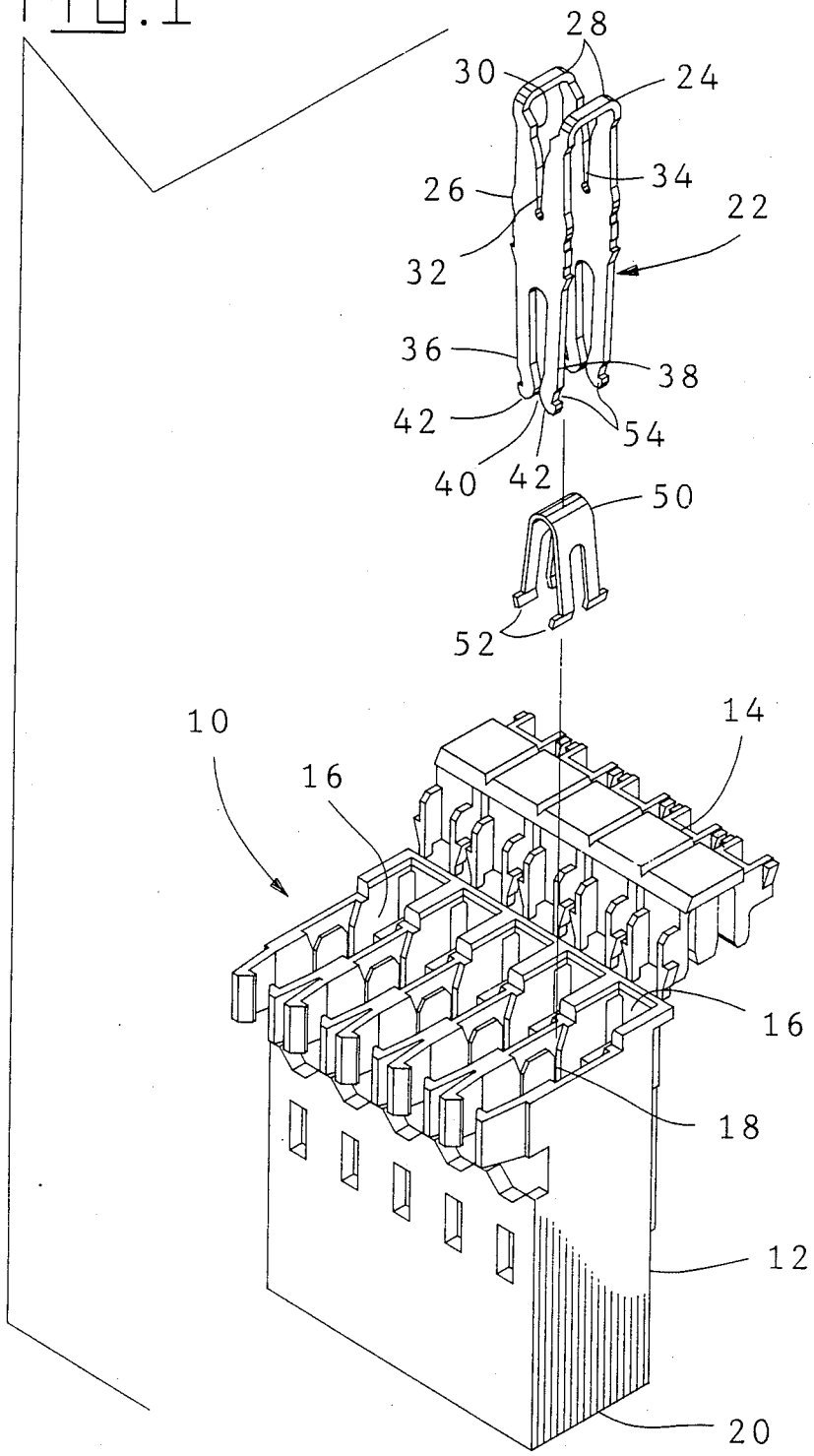
FIG. 1 is a perspective view of a typical connector housing and cover, with the metal contact exploded therefrom, where such contact is designed in accordance with this invention.

Considering such Figures in more detail, a typical connector in which the contact member of this invention may be used is illustrated in FIG. 1. Such a connector is described in greater detail in British Patent Application Ser. No. 8620634, and the description thereof is incorporated by reference.

Such connector 10, by way of example, comprises a housing body 12 and cover member 14 molded in one piece of plastic, i.e. insulative material. The housing body 12 may be formed with a row of elongate cavities 16 opening to opposite cover member receiving and mating ends 18 and 20 respective of the housing body 12.

Into each such cavity there is inserted a metal contact member 22. FIG. 3C shows such member as it enters cavity 16 and prior to engagement with a spring insert, the function of which will be described later. The metal contact member 22 of this invention, shown enlarged in FIG. 2, may be stamped and formed in one piece from a sheet metal strip, such as copper, copper alloy, or bronze. For purposes of illustration, such contact member 22 comprises as the upper portion thereof a conductor connecting end 24 constituted by a pair of interconnected parallel plates 26 joined by a pair of transverse straps 28 to define a wire receiving mouth 30 converging to a pair of aligned wire receiving slots 32 and 34 in respective plates. The lower portions of the contact member comprise extensions of the plates 26 with the end most portions thereof split to define two legs 36 and 38 having a tab receiving slot 40. Where, for example, multiple contact members are used, the respective slots 40 are aligned.

The ends 42 of legs 36 and 38 are designed to converge so as to engage the tab (not shown) when inserted into slot 40. Insertion of such tab therein causes the legs 36 and 38 to spread to accommodate the tab. Without the improvement as provided by this invention, elevated temperatures can cause the soft metal of the contact to relax and lose its spring properties. That is, the legs 36 and 38 fail to maintain effective contact with the tab, or upon withdrawal of the tab return to their preinsertion position.

Figure 2:
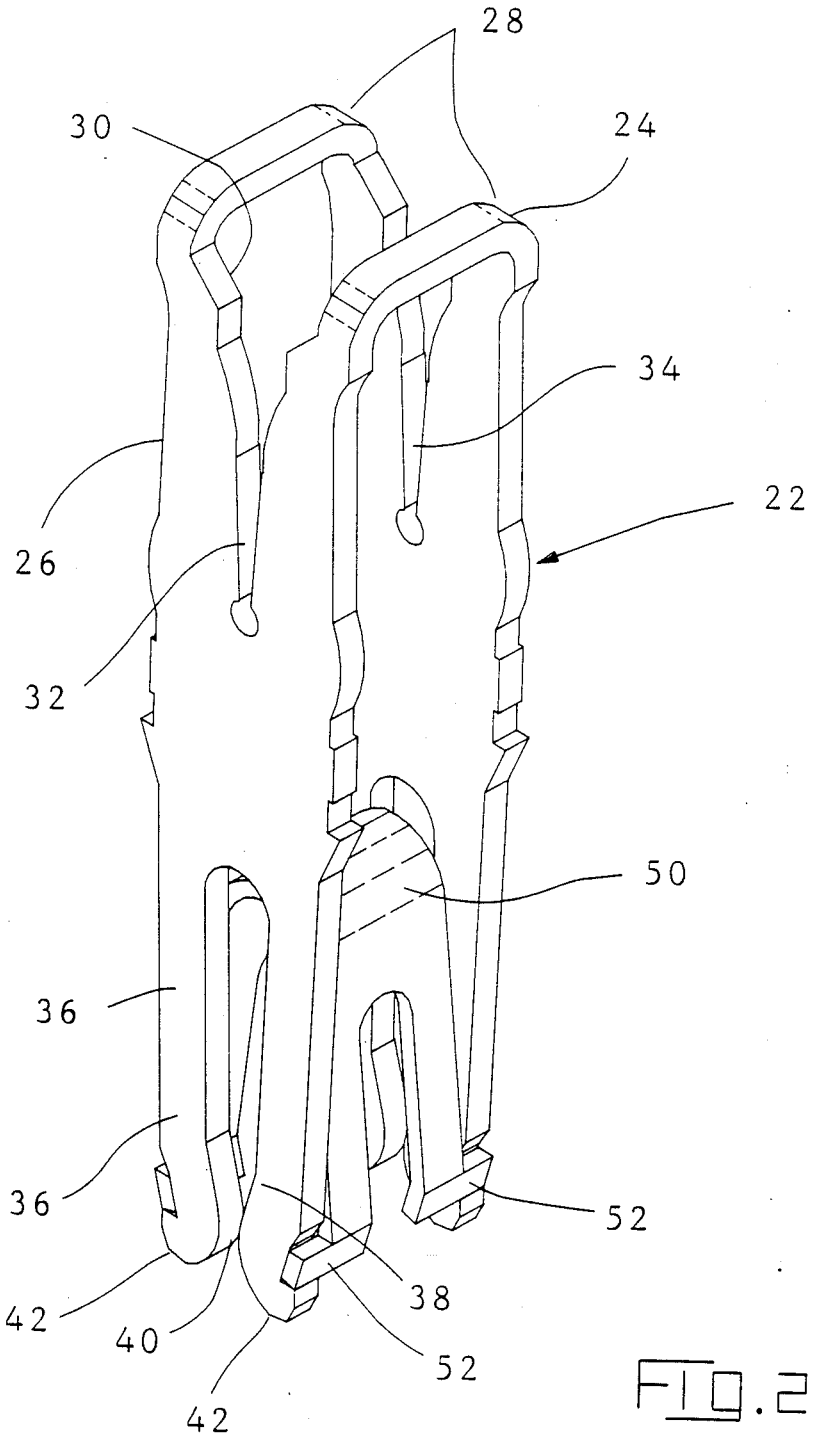
FIG. 2 is an enlarged perspective view of a metal contact member in engagement with the insert of this invention; it being understood that the relationship represents the engaged position within a housing.
Figures 3A, 3B, 3C:
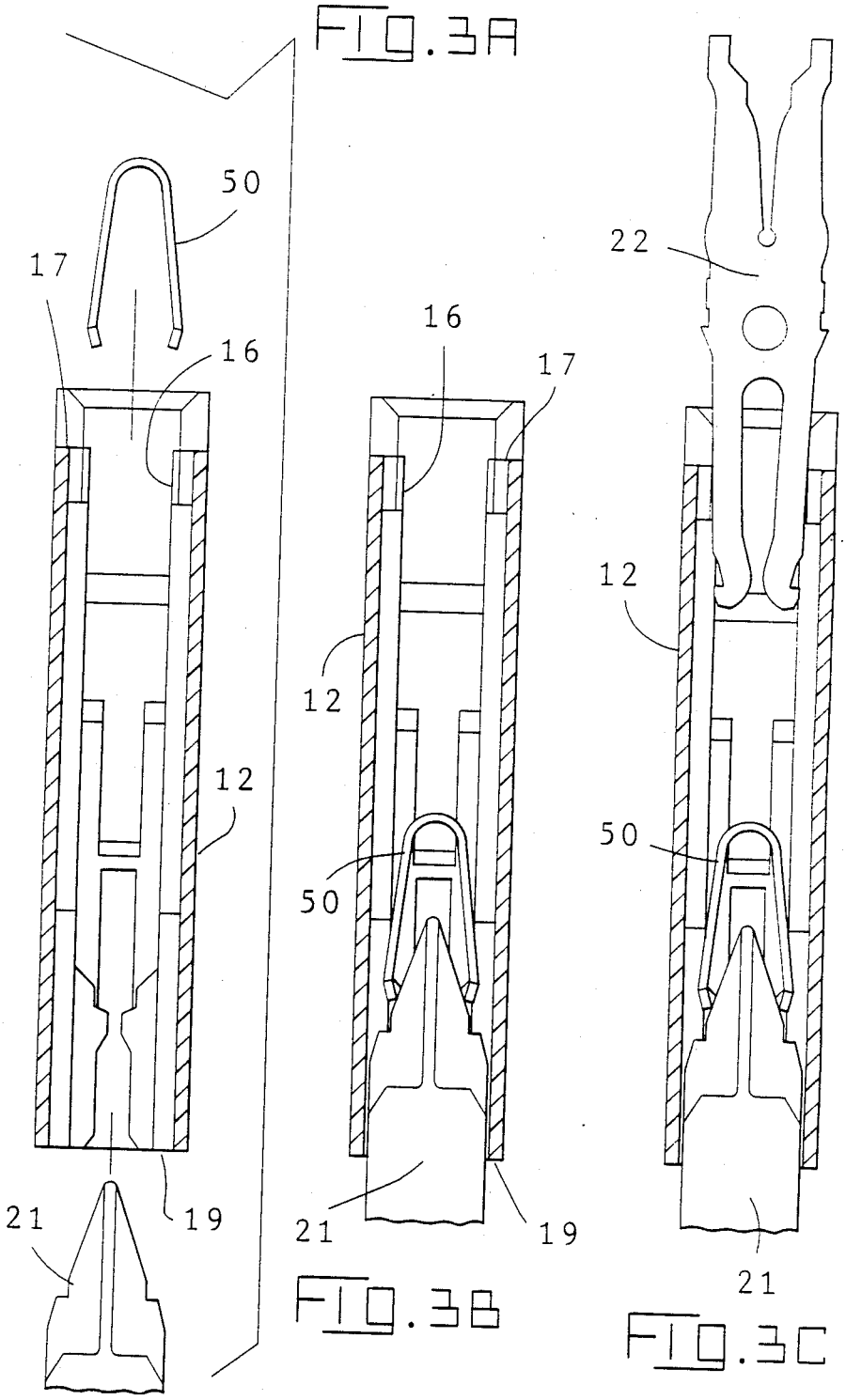
FIGS. 3A to 3C illustrate sequential positions respectively, to show the manner in which the spring metal insert is brought into engagement with the connector housing and prior to engagement with the metal contact member.

The improvement of this invention consists of the addition of the insert 50 best shown in FIG. 2. The insert 50 is typically formed of high-carbon sheet steel and fabricated into a U-shaped configuration having a width to fit between the sets of legs 36 and 38, as shown in the upper portion of FIG. 1. The insert is provided with tab means 52 for engagement with corresponding slots 54 at the ends of legs 36 and 38.

The sequence of FIGS. 3A to 3C best illustrate the manner in which the housing body 12, contact member 22, and insert 50 are brought into engagement. In FIG. 3A, the insert 50 is shown as being pushed into cavity 16 at the top opening 17. From the opposite end 19 a guide support 21 may be inserted to stabilize the insert 50 as the metal contact member 22 is inserted into the cavity 16 through opening 17. By continuing the movement of the contact member 22, the insert 50 is brought into engagement therewith, as shown in FIG. 2. That is, the insert 50 is pushed between the parallel sets of legs 36 and 38 to a sufficient depth to cause the tabs 52 to seat in slots 54. It will be understood that as the tab is inserted into the slot 40, the legs 36 and 38 spread, i.e. move in opposite directions. Coincident with this action, the insert 50 opens under the influence of the legs 36 and 38. In this operable condition, the dominating force of the spring steel insert overcomes any relaxation of the metal contact and maintains good electrical contact between the tab and the metal contact member 22.

I claim:

1. An improved electrical contact member comprising a conductor connecting end constituted by a pair of interconnected parallel plates joined by a pair of transverse straps to define a wire receiving mouth conveying to a pair of aligned wire receiving slots and in respective plates, and a tab receiving end constituted by extensions of said parallel plates with the end most portions thereof split to define two legs and having a tab receiving slot, where each said leg is provided with means for engaging an insert, a U-shaped insert fabricated from a sheet of spring steel and located between said parallel plates in a position perpendicular to the planes of said parallel plates, and seated in said means, where one end of said insert engages corresponding legs of each said plate, and the opposite end of said insert engages the other legs of each said plate, whereby the split legs of each said plate define a common slot with said insert for receiving a tab therein.

2. The improved electrical contact member of claim 1, where said means comprise slots and that tabs of said insert seat within a corresponding slot.

3. The improved electrical contact member of claim 2, wherein said insert is fabricated from high carbon sheet steel.

* * * * *

UNITED STATES PATENT OFFICE

CERTIFICATE OF CORRECTION

Patent No. 4,895,531 Dated January 23, 1990

Inventor(s) Guido Vignoli

It is certified that error appears in the above-identified patent and that said Letters Patent is hereby corrected as shown below:

Claim 1, column 3, line 11, change "conveying" to --converging--.

Signed and Sealed this

Twenty-third Day of April, 1991

*Attest:*

*Attesting Officer*

HARRY F. MANBECK, JR.

*Commissioner of Patents and Trademarks*